US005982282A

United States Patent [19]

Ryan, Jr.

[11] Patent Number: 5,982,282

[45] Date of Patent: Nov. 9, 1999

[54] PRODUCT AUTHENTICATION INDICIA CONCEALED IN MAGNETOMECHANICAL EAS MARKER

[75] Inventor: Joseph M. Ryan, Jr., Atlantis, Fla.

[73] Assignee: Sensormatic Electronics Corporation, Boca Raton, Fla.

[21] Appl. No.: 09/154,398

[22] Filed: Sep. 16, 1998

[51] Int. Cl.[6] ..... G08B 13/187

[52] U.S. Cl. ..... 340/572.1; 40/625; 116/1; 116/4; 116/200; 116/201; 116/DIG. 1; 340/572.8

[58] Field of Search ..... 340/572.1, 572.8; 116/1, 4, 200, 201, DIG. 1; 40/625

[56] References Cited

U.S. PATENT DOCUMENTS

| | | | |
|---|---|---|---|
| 4,433,437 | 2/1984 | Fantone | 382/210 |
| 4,510,489 | 4/1985 | Anderson, III et al. | 340/572.1 |
| 5,313,193 | 5/1994 | Dubois et al. | 340/572.1 |
| 5,477,219 | 12/1995 | Zarembo et al. | 340/572.8 |
| 5,499,015 | 3/1996 | Winkler et al. | 340/551 |
| 5,548,106 | 8/1996 | Liang et al. | 235/454 |
| 5,565,849 | 10/1996 | Ho et al. | 340/572.6 |
| 5,714,935 | 2/1998 | Ryan, Jr. | 340/572.3 |
| 5,825,290 | 10/1998 | Lian et al. | 340/572.6 |
| 5,859,587 | 1/1999 | Alicot et al. | 340/572.1 |
| 5,898,370 | 4/1999 | Reymond | 340/572.1 |

*Primary Examiner*—Glen Swann
*Attorney, Agent, or Firm*—Robin, Blecker & Daley

[57] ABSTRACT

A conventional magnetomechanical EAS marker is modified to aid in authenticating an article of merchandise to which the marker is to be applied. The marker includes a housing, a magnetostrictive element in the housing, a bias magnet mounted to the housing, and an authentication element in the housing for indicating the authenticity of the item to which the marker is to be applied. The authentication element may be a printed logo, bar code or character string or a discrete element having distinctive or rare characteristics.

25 Claims, 2 Drawing Sheets

PRODUCT AUTHENTICATION INDICIA CONCEALED IN MAGNETOMECHANICAL EAS MARKER

FIELD OF THE INVENTION

This invention in general relates to authentication of articles of merchandise, and is more specifically concerned with providing anti-counterfeiting indicia in a concealed position on articles of merchandise.

BACKGROUND OF THE INVENTION

Counterfeiting of consumer and commercial goods is a significant problem. It has previously been proposed to discourage counterfeiting by securing indicia of authenticity to articles of merchandise. Proposals in accordance with the prior art have included an optically-scannable security label which has parallel lenticules of a pre-determined spatial frequency, as described in U.S. Pat. No. 4,433,437, issued to Fantone.

According to another proposal, electronic article surveillance (EAS) components may be integrated or embedded in an article of merchandise, and may be detected to verify the authenticity of the article of merchandise, as disclosed in U.S. Pat. No. 5,499,015, issued to Winkler et al. and commonly assigned with the present application.

The prior art has not recognized that conventional enclosures for magnetomechanical EAS markers present opportunities for concealing, and therefore increasing the effectiveness of, product authentication elements.

OBJECTS AND SUMMARY OF THE INVENTION

It is a primary object of the present invention to provide a technique for verifying the authenticity of articles of merchandise.

It is a further object of the invention to provide a product authentication label in a highly cost-effective manner.

According to a first aspect of the invention, there is provided a magnetomechanical EAS marker, including a housing, a magnetostrictive element in the housing, an element for applying a bias magnetic field to the magnetostrictive element, and an authentication element in the housing for indicating authenticity of an item to which the marker is attached. The authentication element may take the form of a printed indicia on an inner surface of the housing. The printed indicia may include one or both of alphanumeric characters and a bar code. It is to be understood that "alphanumeric characters" include one or both of alphabetic characters and numeric characters.

It is also contemplated that the authentication element may be a discrete element of a distinctive material, provided separately from the magnetostrictive element and the bias magnet conventionally found in magnetomechanical EAS markers. It is also contemplated that, if the authentication element takes the form of a printed indicia, such indicia may be printed on one or both of the magnetostrictive element or the bias element, in addition to or instead of printing on the inner surface of the marker housing.

According to another aspect of the invention, there is provided a method of verifying the authenticity of an article of merchandise, including the steps of providing a magnetomechanical EAS marker which includes a housing, a magnetostrictive element in the housing selected to provide a signal that is detectable by a magnetomechanical EAS system, and an authentication element in the housing for indicating authenticity of an article to which the marker is to be attached, attaching the marker to an article of merchandise, after the attaching step, opening the housing to make the authentication element available for inspection, and after the opening step, inspecting the authentication element.

According to a further aspect of the invention, an article of merchandise has an authentication element, such as a printed authentication code, on a surface of the article, and an EAS marker secured to the surface of the article in a position to conceal the authentication element.

BRIEF DESCRIPTION OF THE DRAWINGS

The same or similar reference numerals are used throughout the drawings to designate the same or similar parts.

DESCRIPTION OF PREFERRED EMBODIMENTS

A first embodiment of the invention will now be described with reference to FIG. 1.

Figure 1:
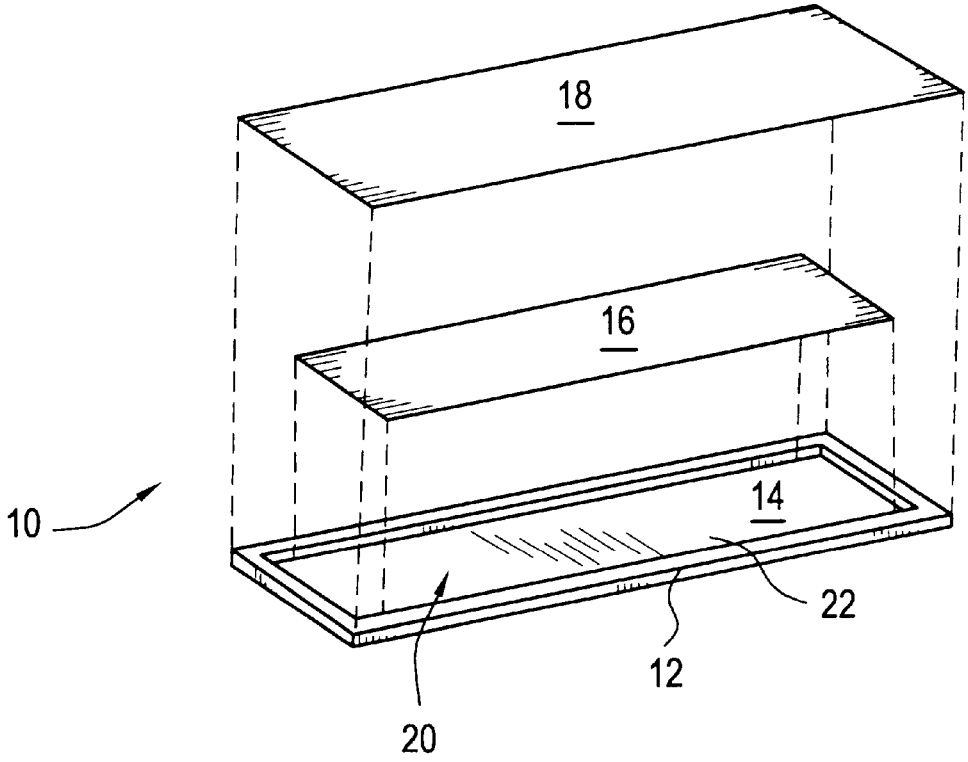
FIG. 1 is an isometric, exploded view showing a magnetomechanical EAS marker modified in accordance with the invention to include an authentication element.

In FIG. 1, reference numeral 10 generally indicates a magnetomechanical EAS marker. The marker 10 is preferably of conventional construction, for the most part, but modified according to the invention as will be described below. The marker 10 includes a rigid or semi-rigid housing 12 which is shaped to form a hollow recess 14. The housing may be formed of molded plastic. A magnetostrictive strip 16 is provided for placement in the recess 14. The strip 16, which constitutes the active element of the marker 10, may be formed in accordance with conventional practices, such as those described in U.S. Pat. No. 4,510,489, issued to Anderson, III, et al. (The disclosure of the Anderson patent is incorporated herein by reference.) Another conventional component of magnetomechanical EAS markers is the bias magnet, indicated by reference numeral 18 in FIG. 1. The bias magnet 18 also is preferably formed in accordance with conventional practice, of which examples are disclosed in the above-referenced Anderson patent. The bias magnet 18 is shown in FIG. 1 as being provided to close the recess 14; according to a known marker construction practice a plastic membrane (not shown) is used to cover the recess 14, with the active strip 16 inside the recess, and the bias magnet 18 installed on the outer side of the membrane. Once the plastic membrane is in place, it can be considered to be part of the marker housing.

In accordance with the first embodiment of the invention, an authentication element is provided in the form of a bar code 20 printed on an inner surface 22 of the marker housing 12. As will be appreciated from FIG. 1, when the marker 10 is in a fully assembled condition, the bar code 20 is concealed within the recess 14 formed by the housing 12.

The bar code 20 shown in FIG. 1 is a conventional bar/half-bar code, but other bar code formats may be employed. For example, the bar code format conventionally used to indicate the UPC (universal product code) may be used. The amount of data represented by the bar code 20 may be more or less than the 8 to 10 bits represented in the drawing. The printing of the bar code may be performed in accordance with conventional printing processes and preferably takes place prior to placement of the active strip 16 in the recess 14. Any conventional type of ink may be employed, including infra-red ink.

According to one technique for assembling the marker 10, the housing 12 is first provided, then the bar code 20 printed on the surface 22 of the housing 12 by ink-jet printing, for example. Next the active strip 16 is placed in the recess 14. Then a membrane (not shown) is applied to close the recess with the active strip 16 in the recess. Finally, the bias magnet 18 is mounted on the outer side of the membrane. It is also contemplated to apply an adhesive layer, by any conventional technique, either on the top surface of the bias magnet 18 or on the bottom surface of the marker housing 12. As is well known to those who are skilled in the art, the adhesive layer may be utilized to attach the marker 10 to an article of merchandise to be protected by the marker 10. Also in accordance with conventional practice, a release liner may be applied to cover the adhesive for convenient handling of the marker prior to attaching the marker on the article of merchandise.

Authentication of the article of merchandise to which the marker 10 has been attached may be accomplished by opening the housing to make the bar code 20 available for inspection. The process of opening the housing may include removing the plastic membrane referred to above, as well as the marker elements 16 and 18. Inspection of the bar code 20 can then proceed by, for example, reading the bar code 20 with a suitable bar code reader device.

It is to be understood that the bar code 20 printed on the housing 12 may be selected so as to be unique to the product to which the marker 10 is to be applied and/or to the manufacturer of the product and/or to the retail store in which the product is made available for sale and/or to a chain of retail stores. Among other possibilities, the bar code may represent the UPC or a stock keeping unit (SKU) code for the item of merchandise to which the marker is to be attached. If a sufficient number of bits are provided, each marker may be uniquely coded. Authentication of the product may derive merely from the presence of the bar code, or may be based on verifying that the code corresponds to the predetermined "correct" code for the respective product, retail location, retail chain and/or manufacturer, etc.

Preferably the housing 12, like conventional housings, is "tamper-evident", in the sense that it is difficult or impossible to open the housing and then to reclose the housing, without leaving evidence of such operations. Consequently, an effective counterfeiting scheme would require more than just buying conventional magnetomechanical markers and applying them to the counterfeit articles. Rather, the counterfeiter would need to have a capability for printing the bar code on the interior of a marker housing and then manufacturing the marker. This requirement is likely to present a substantial barrier and deterrent to successful counterfeiting.

Figure 2:
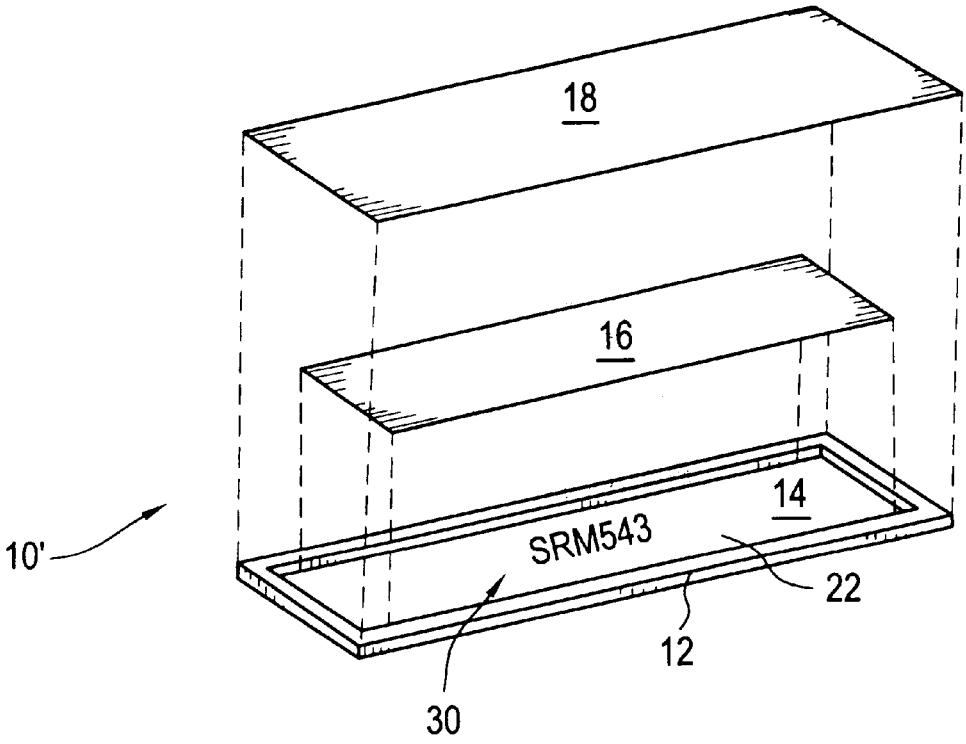
FIG. 2 is a view similar to FIG. 1 showing a magnetomechanical EAS marker modified according to a second embodiment of the invention.

FIG. 2 shows a slightly modified version (represented by reference character 10') of the marker of FIG. 1. In the marker 10' of FIG. 2, an alphanumeric character string 30 takes the place of the bar code shown in FIG. 1. In the marker 10', the character string 30 is printed directly on the inner surface 22 of the marker housing 12. The product authentication procedure referred to above in connection with FIG. 1 may be changed so that the inspection of the character string 30 (which serves as an authentication element) may be performed without any reading device, and hence with the naked eye of the person performing the authentication procedure. Alternatively, it is contemplated to use optical character reading equipment to machine-read the character string 30 in order to determine whether the character string 30 represents a valid product authentication code. As before, the character string may be such as uniquely identifies one or more of the product unit, product type, retail location, retail chain, product manufacturer, etc.

Figure 3:
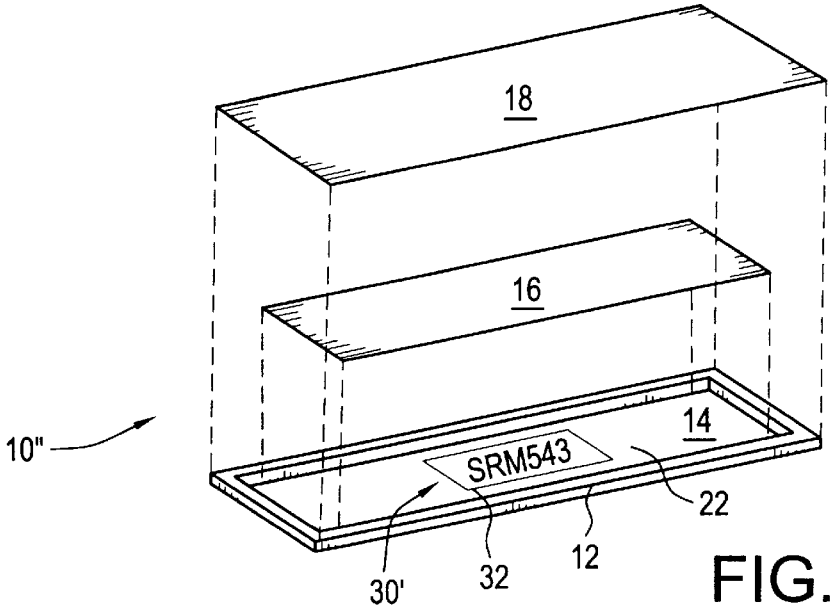
FIG. 3 is a view similar to FIGS. 1 and 2 showing a magnetomechanical EAS marker modified according to a third embodiment of the invention.

A third embodiment of the invention is shown in FIG. 3 and indicated by reference character 10". The embodiment of FIG. 3 differs from the second embodiment in that a label 32, having printed thereon a character string 30', takes the place of the character string 30 shown in FIG. 2. It will be recognized that the label 32 is adhered to the inner surface 22 of the marker housing 12.

Figure 4:
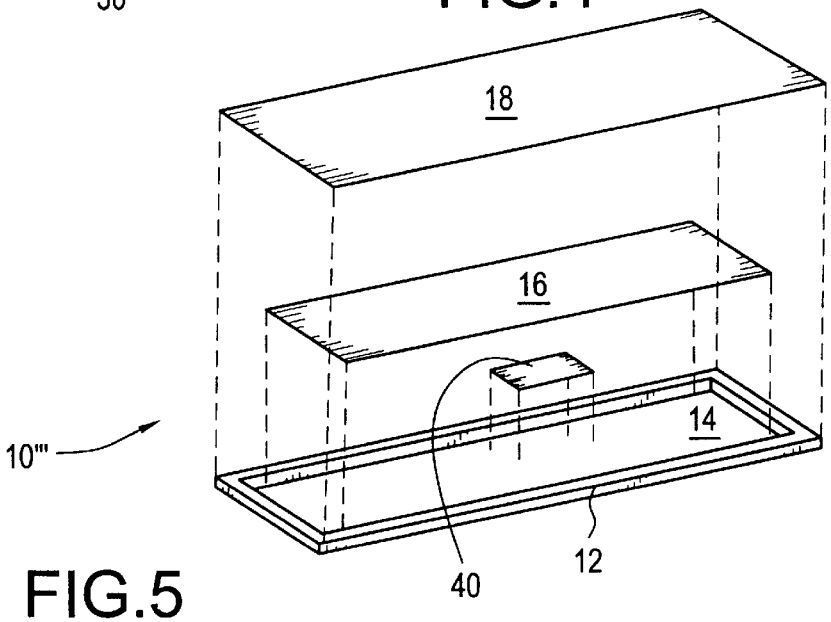
FIG. 4 is a view similar to FIGS. 1–3, showing a magnetomechanical EAS marker modified according to a fourth embodiment of the invention.

A fourth embodiment of the invention is shown in FIG. 4, and indicated by reference character 10'". In the embodiment of FIG. 4, the authentication element takes the form of a discrete piece of material 40, placed in the recess 14 together with the magnetostrictive strip 16. The authentication element 40 may be formed, partially or entirely, of any suitable distinctive and/or rare material which may be difficult or inconvenient for a counterfeiter to find or use. The distinctiveness of the authentication element 40 may lie in its chemical composition, shape, texture, color, or other attribute, whether inherent or resulting from a distinctive process applied to the element 40. One or more of the characteristics of the authentication element 40 may be detectable with the naked eye or only by suitable analysis, such as chemical analysis or detection of an electrical, magnetic or electronic characteristic of the element. To give but one example, the authentication element 40 may include genetic material such as DNA derived or obtained from a plant, animal or single-celled creature.

It is to be understood that the product authentication procedures referred to above would, in the case of the marker embodiment of FIG. 4, include such inspection procedure or procedures as required to detect the distinctive characteristic or characteristics of the authentication element 40. Such inspection may include one or more of human visual inspection, machine-optical inspection and chemical analysis.

Although the authentication element 40 is shown in FIG. 4 as being placed below the active strip 16 (i.e. on the opposite side of the strip 16 from the bias magnet 18) it is also contemplated that the authentication element 40 be placed in a position between the active strip 16 and the bias magnet 18, or in another convenient position within the recess 14 formed by the marker housing 12. It is also contemplated to adhere the authentication element to one or more of the active strip 16, the bias magnet 18, and the inside of the marker housing 12. The installation of the element 40 in the housing 12 should be performed so as not to interfere with the mechanical oscillation undergone by the active strip 16 when exposed to an EAS interrogation field.

In the cases where the authentication element takes the form of a printed bar code, character string, etc., the authentication element may be printed on one or more of the active strip 16 and the bias magnet 18 or on a sticker applied to one of the strip 16 and the magnet 18. Where a printed authentication element is employed, it may include one or more graphic elements and/or a distinctive logo or logos, alone or in combination with a bar code and/or a character string. A combination of a bar code and a character string may also be used without other printed material.

It is also contemplated to use two or more of the authentication elements described above in a single marker. In such a case, authentication elements of the same kind or of different kinds may be employed.

A marker housing formed of molded plastic has been referred to above, but it is also contemplated to form the housing by folding paper stock, in accordance with a conventional practice. In the latter case, an authentication code may advantageously be printed on the paper stock prior to folding, and the folding performed so as to leave the printed authentication code on an inner surface of the housing.

It is also contemplated that a self-biasing active strip be used in the marker in accordance with the teachings of U.S. Pat. No. 5,565,849 or patent application Ser. No. 08/800,772, which was filed on Feb. 14, 1997 and has been allowed. If a self-biasing active strip is used, the separate bias magnet may be omitted.

Figure 5:
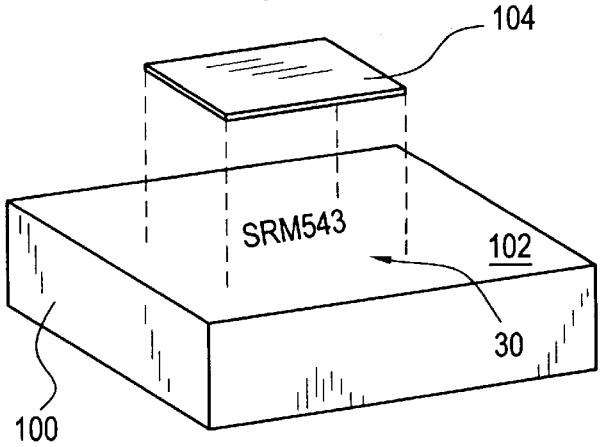
FIG. 5 is an isometric, exploded view of an article of merchandise having an authentication code and an EAS marker installed thereon according to a fifth embodiment of the invention.

FIG. 5 illustrates another embodiment of the present invention, in which an article of merchandise 100 has an authentication code 30 (specifically, a character string) printed on a surface 102 of the article of merchandise. An EAS marker 104 is secured to the surface 102 in a position to conceal the authentication code 30.

In place of the authentication code 30, any of the other authentication elements previously referred to may be secured to the surface 102 of the article of merchandise 100. The EAS marker 104 may be of any conventional type, such as a magnetomechanical marker or a harmonic-type marker, provided that the marker is substantially opaque so that it will function to conceal the authentication element. If the marker 104 is of the magnetomechanical type, it may be of the sorts illustrated in FIGS. 1–4 herein; i.e., it may include another authentication element concealed within the marker housing. The authentication element inside the marker housing may be of the same type, and indeed identical to, the authentication element concealed on the surface of the article of merchandise underneath the marker.

When it is desired to verify the authenticity of the article of merchandise, the EAS marker 104 is removed from the surface 102 of the article to make the authentication code 30 available for inspection.

Like the previous embodiments, the embodiment of the invention illustrated in FIG. 5 is particularly suited for use when "source tagging" is employed. According to the practice of source tagging, an EAS marker is applied to an article of merchandise at the manufacturing plant or at a distribution point. If the embodiment of FIG. 5 is employed, and an article of merchandise is seen in a retail store with its authentication code visible, it can be concluded that the article either has been tampered with by removal of the EAS marker, or the article is counterfeit. Moreover, the use of the marker to hide the authentication code helps to conceal the authentication scheme from malefactors. This additional safeguard can be achieved quite efficiently, since the step of concealing the authentication code is combined with the step of applying the EAS marker to the article of merchandise.

A variety of changes in the above-described articles and practices may be introduced without departing from the invention. The particularly preferred embodiments of the invention are thus intended in an illustrative and not limiting sense. The true spirit and scope of the invention are set forth in the following claims.

What is claimed is:

1. A magnetomechanical EAS marker, comprising:

a housing;

a magnetostrictive element in said housing;

means for applying a bias magnetic field to said magnetostrictive element; and authentication means in said housing for indicating authenticity of an item to which said marker is attached.

2. A magnetomechanical EAS marker according to claim 1, wherein said authentication means is a printed indicia.

3. A magnetomechanical EAS marker according to claim 2, wherein said printed indicia is on an inner surface of said housing.

4. A magnetomechanical EAS marker according to claim 3, wherein said printed indicia includes alphanumeric characters.

5. A magnetomechanical EAS marker according to claim 3, wherein said printed indicia includes a bar code.

6. A magnetomechanical EAS marker according to claim 1, wherein said authentication means includes a material deposited in said housing adjacent said magnetostrictive element.

7. A magnetomechanical EAS marker according to claim 1, wherein said means for applying said bias magnetic field includes a bias magnet mounted to said housing adjacent to said magnetostrictive element.

8. A magnetomechanical EAS marker according to claim 1, further comprising an-adhesive on an outside surface of said housing for securing said housing to an article of merchandise.

9. A magnetomechanical EAS marker, comprising:

a housing;

a magnetostrictive element in said housing;

means for applying a bias magnetic field to said magnetostrictive element; and a printed indicia on an inner surface of said housing.

10. A magnetomechanical EAS marker according to claim 9, wherein said indicia is formed of ink applied directly to said inner surface of said housing.

11. A magnetomechanical EAS marker according to claim 9, wherein said indicia is on a sticker applied to said inner surface of said housing.

12. A magnetomechanical EAS marker according to claim 9, wherein said indicia is formed of infrared ink.

13. A magnetomechanical EAS marker according to claim 9, wherein said indicia includes alphanumeric characters.

14. A magnetomechanical EAS marker according to claim 9, wherein said indicia includes a bar code.

15. A method of verifying the authenticity of an article of merchandise, the method comprising the steps of:

providing a magnetomechanical EAS marker, the marker including a housing, a magnetostrictive element in said housing, said magnetostrictive element selected to provide a signal that is detectable by a magnetomechanical electronic article surveillance system, and authentication means in said housing for indicating authenticity of an item to which said marker is to be attached;

attaching said marker to an article of merchandise;

after said attaching step, opening said housing to make said authentication means available for inspection; and after said opening step, inspecting said authentication means.

16. A method according to claim 15, wherein said authentication means is a string of printed alphanumeric characters and said inspecting step includes reading the alphanumeric characters with the naked eye.

17. A method according to claim 16, wherein said providing step includes printing the character string on an inner surface of said housing.

18. A method according to claim 15, wherein said authentication means is a bar code and said inspecting step includes scanning said bar code with a bar code reader.

19. A method according to claim 18, wherein said providing step includes printing the bar code on an inner surface of said housing.

20. An article of merchandise including authentication means for indicating authenticity of said article of merchandise, said authentication means being secured to a surface of said article of merchandise, and an EAS marker secured on said surface of the article of merchandise in a position such that said EAS marker conceals said authentication means.

21. An article of merchandise according to claim 20, wherein said authentication means is an indicia printed on said surface of the article.

22. An article of merchandise according to claim 20, wherein said EAS marker is a magnetomechanical EAS marker.

23. A method of protecting an article of merchandise from counterfeiting, comprising the steps of:

securing authentication means to a surface of said article of merchandise, said authentication means for indicating authenticity of said article of merchandise;

after said securing step, attaching an EAS marker to said surface of said article of merchandise in a position to conceal the authentication means;

after said attaching step, removing said EAS marker from said surface of said article of merchandise to make said authentication means available for inspection; and after said removing step, inspecting said authentication means.

24. A method according to claim 23, wherein said securing step includes printing an indicia on said surface of said article of merchandise.

25. A method according to claim 23, wherein said EAS marker is a magnetomechanical EAS marker.

* * * * *

UNITED STATES PATENT AND TRADEMARK OFFICE

CERTIFICATE OF CORRECTION

PATENT NO. : 5,982,282

DATED : November 9, 1999

INVENTOR(S) : Joseph M. Ryan, Jr.

It is certified that error appears in the above-identified patent and that said Letters Patent are hereby corrected as shown below:

Col. 6, line 30, delete "an-adhesive" and insert -- an adhesive --.

Signed and Sealed this

Third Day of April, 2001

*Attest:*

Nicholas P. Godici

NICHOLAS P. GODICI

*Attesting Officer*

*Acting Director of the United States Patent and Trademark Office*